United States Patent [19]

Tardot

[11] 4,360,117

[45] Nov. 23, 1982

[54] AUTOMATIC MEANS FOR EJECTING A PAYLOAD FROM ITS CONTAINER

[75] Inventor: Jacques Tardot, Gond Pontouvre, France

[73] Assignee: L'Etat Francais represente por le Deleque Ministeriel pour l'Armement, Paris, France

[21] Appl. No.: 148,806

[22] Filed: May 12, 1980

[30] Foreign Application Priority Data

May 10, 1979 [FR] France ..... 79 11825

[51] Int. Cl.[3] ..... B65D 8/14; B64D 1/08

[52] U.S. Cl. ..... 220/4 R; 220/4 F; 244/138 R; 244/138 A

[58] Field of Search ..... 220/4 R, 4 B, 4 E, 4 F; 244/138 R, 138 A

[56] References Cited

U.S. PATENT DOCUMENTS

| | | | |
|---|---|---|---|
| 2,990,149 | 6/1961 | Samms | 244/138 A |
| 3,273,834 | 9/1966 | Bower | 244/138 A |
| 3,302,819 | 2/1967 | Kennedy | 220/4 B |
| 3,391,885 | 7/1968 | Genco | 150/0.5 |
| 3,552,549 | 1/1971 | Creese | 220/4 R |
| 3,894,648 | 7/1975 | Croullebois | 244/138 R |
| 3,964,700 | 6/1976 | Adams | 244/138 R |

*Primary Examiner*—George E. Lowrance

*Attorney, Agent, or Firm*—Stevens, Davis, Miller & Mosher

[57] ABSTRACT

An assembly of a payload and container is described whereby a payload support having a base with a perimeter enclosed by a sidewall forming a cup for receiving a tubular container is provided. A first and second tie are connected to one end of the tubular container, and are terminated in an elastic ring. The first and second ties have a length which will permit the elastic ring to be placed in an annular groove in the exterior sidewall of the cup, thereby fixing the payload support to the container. During free flight of the assembly, air flow moves the first and second ties away from the container freeing the elastic ring from the annular groove in the cup whereby the container separates from the payload support.

5 Claims, 3 Drawing Figures

10
14
6
5
5
6

5
5
7
7
6
6
4
4
14
8
1
14
8
2
3
13
2
12
3

5
5
7
4
6
7
6

8
11
11
8
14
10
2
9
3

AUTOMATIC MEANS FOR EJECTING A PAYLOAD FROM ITS CONTAINER

BACKGROUND OF THE INVENTION

The present invention relates to an automatic means for ejecting a payload such as a sonobuoy from its container.

As a rule, sonobuoys consist of a payload having electronic circuits and apparatus for receiving and/or transmitting signals, and a container for housing other apparatus associated with the electronic circuits such as a folded antenna, braking parachute, etc. The combination of the payload and the container is jettisoned from an aircraft such as an airplane and means are provided for detaching the container from the payload to permit deploying of the parachute. In addition to the payload container assembly, the combination also comprises means for locking or assembling the container with the payload during storage, handling or a non-use period, the locking means being unlocked only at the time of the drop or immediately thereafter when the assembly is in free flight.

All known means for separating or ejecting the payload from the container are more or less complex, and accordingly relatively difficult to manufacture and use. It is therefore an object of the present invention to create an ejection means which is easy to implement, reliable in operation and permits any kind of handling while in storage.

SUMMARY OF THE INVENTION

It is a primary object of this invention to provide an ejection means for separating a payload from a container during free flight of the payload-container assembly.

This and other objects are accomplished by apparatus in accordance with the invention. The present invention provides for at least first and second flexible ties, each connected at one end of the container. The container has a second end disposed into a cup formed in the payload support. The remaining ends of the ties terminate in an elastic annular ring which is held in an annular groove formed in the payload support.

In one embodiment of the invention, the container is formed from a tube. First and second cylindrical half-shells are pivoted near one end of the tube and form a surface spaced apart from the tube and at least partially enclose the tube. The remaining ends of the shells are free and may freely pivot. The payload support comprises a base having its perimeter enclosed by a sidewall. The remaining end of the tube is formed to fit within the sidewalls against the base. The sidewall thickness and space between the shells and the tube are selected to permit the base of the shells to enclose the sidewall. The sidewall has two annular grooves which receive complementary ribs formed near the base of the shells. First and second ties are connected to each shell and terminate around an elastic ring which surrounds the shell members and is seated on the interior surface of one of the ribs formed in said shells.

The payload separates from the container during free flight when moving air between the ties and outer shells forces the elastic ring out of the interior surface of the rib permitting the tube to withdraw from the payload support.

DESCRIPTION OF THE PREFERRED EMBODIMENT

Figures 1, 2, 3:
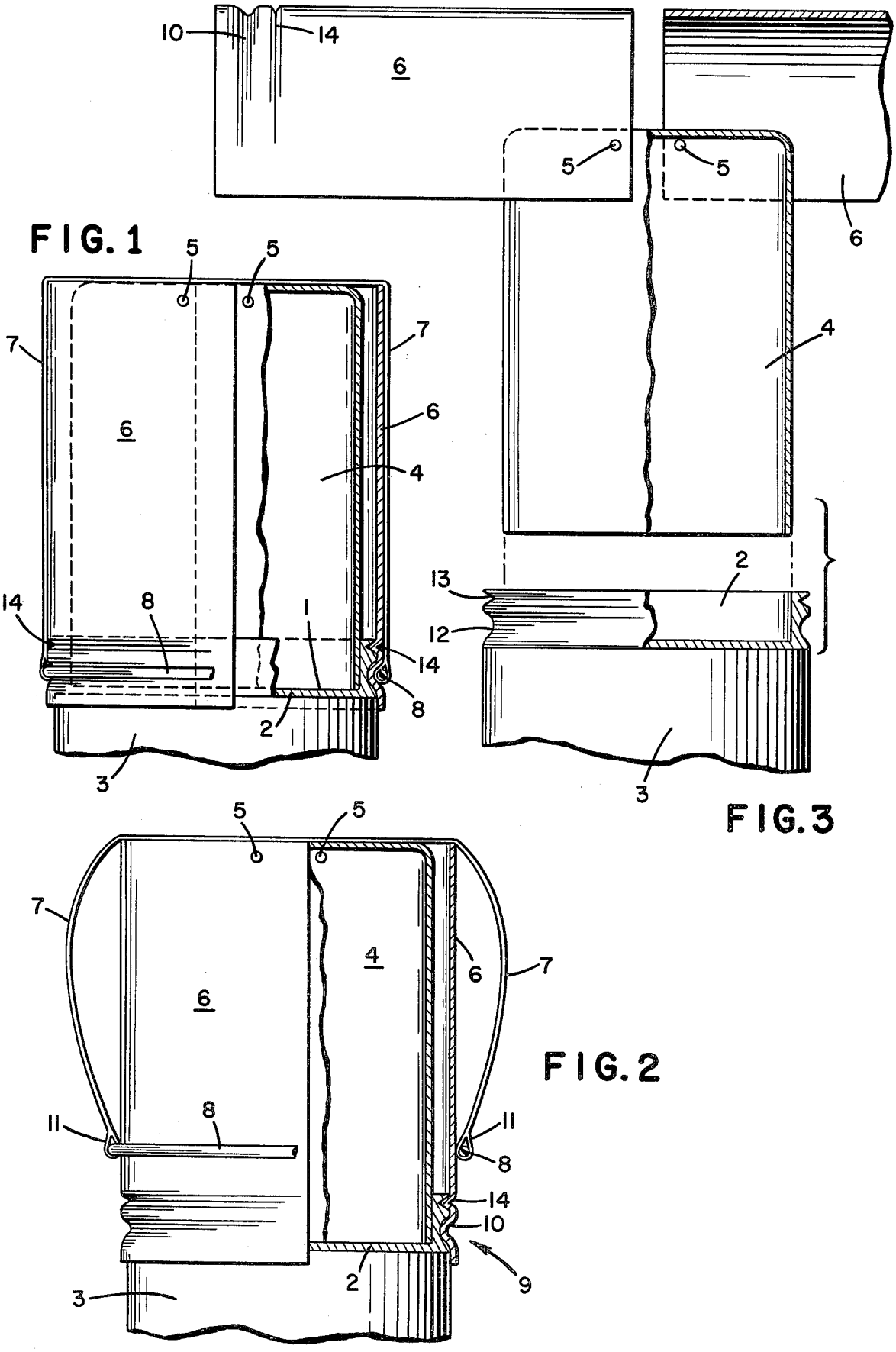
FIG. 1 is a view, partly in cross-section and partly in elevation, of an embodiment of an apparatus according to the invention.
FIG. 2 is a view, partly in cross-section and partly in elevation, similar to FIG. 1, with the elastic member out of its seat.
FIG. 3 is a partial view in elevation of the half-shells being deployed and the tube out of the support.

The jettisoning means for a payload comprises a support 1 in the shape of a shallow cup 3 which can be integral with the body of the payload 3 or else be joined to the body of the payload and fixed to it in an appropriate way.

A tube means 4 consisting of one or more parts whether interconnected or not, assumes the function of a container for the various components of the payload, such as the parachute, antenna, etc. The tube means 4 is seated by its open base in the support 1, the inside dimensions of the shallow cup 2 and the outside dimensions of the tube means 4 being so selected there will be no play between them.

At least two half-shells 6 hinge on shafts 5 at the upper end of the tube means 4 and in the folded condition form a cylinder of which the inside dimensions exceed the outside dimensions of the support 1. Further, the lateral area of each half-shell 6 exceeds half the lateral area of the tube means 4. Therefore, all of the lateral area of the tube means 4 is covered by the half-shells 6 which slightly overlap one another.

One end of the ties 7 are fixed to each of the half-shells 6 at any point in the upper part of the lateral surface of the half-shells. The ties 7 may be present in pairs and may be in the shape of rectangular strips of a length approximately equal to the height of the half-shells 6 or of the tube means 4, their width and thickness being about 50 mm and 0.15 mm, respectively.

The other end of each ties 7 is shaped so as to permit coupling of an elastic member 8 in the shape of an annular bead which is to be placed along the interior surface 9 of an outside annular rib 10 formed in the half-shells 6. The geometric adaptation of the seat 11 of the elastic member 8 is such that it cannot excessively move within the seat 11 either when stored or in operational condition.

The rib 10 perfectly adapts into the hollow of a corresponding groove 12 fashioned at the periphery of the support 1.

The support 1 furthermore comprises an annular groove in the shape of a notch 13 into which is seated a centering and locking stud 14 provided on each of the half-shells 6.

When the payload is in storage, the combination is as shown in FIG. 1. The studs 14 and the elastic bead 8 constituting the elastic member ensure that the container remains on the support 1, while the ties 7 are pressed against the half-shells. If necessary, they may be kept in this condition by winding an adhesive tape around the ties and hence around the half-shells, said adhesive tape being arbitrary and removed when the combination is boarded on transport means from which the payload will be dropped.

When the payload is jettisoned from an airplane or any other aerial transport means, air forces itself between the half-shells 6 and the ties 7 which provides enough drag so the annular bead 8 is pulled out of the housing 9. The drag depends on the nature of the material used to make said ties and the dimensions of the ties. In one embodiment, the ties are made from flexible aluminum foils and have the aforementioned dimensions.

The moment the annular bead 8 is pulled out of its seat 9, it will slide along the half-shells 6 while the ties bulge, thus allowing the half-shells 6 to be deployed about the pivot shafts 5.

In the fully deployed condition of the half-shells, the container or tube means 4 tends to disengage from the support 1 due to the pressure exerted on the inside surfaces of said half-shells. When the container 4 has separated from the support 1, the components therein contained are released and henceforth can operate as intended.

Clearly, the invention is not restricted to the above-described embodiment, but on the contrary covers many variations. For example, the container and the half-shells may be replaced a container formed from two halves of a tube pivoted together at one end and the remaining ends being free to pivot from each other. The remaining ends of the halves of the tube have at least one inwardly extending ridge for mating with one of the grooves in a payload support member having at least one annular groove on its exterior surface. First and second ties would be connected to the exterior surface of each half of the tube with the tie members extending from the connection point to the inwardly extending ridge and being connected to an elastic annular ring disposed in the inwardly extending ridge along the exterior surface of the tube halves. The elastic ring would hold the tube halves in the support member in an assembly until during free flight at which time air rushing between the ties and the tube halves would force the ties away from the tube halves thereby pulling the elastic ring out of the inwardly extending ridge and freeing the support member from the container.

In yet another embodiment, a payload support formed from a base with its perimeter enclosed by a sidewall forming a cup with an annular groove in the sidewall would receive a tubular container having one end with a shape and perimeter for fitting into the cup structure. First and second ties would be connected to the container at a point adjacent the end of the container not inserted into the cup-like structure. The other ends of the ties would terminate and be secured to an elastic ring which would be placed in the annular groove of the sidewall of the payload support. The container would thus be held fixed to the payload support during storage but during free flight of the assembly, a flow of air would force the ties away from the container and thus force the elastic ring out of the groove and releasing the container from the payload support.

What is claimed is:

1. A container assembly for releasing its payload during free flight of the assembly, comprising:

a payload support having a cup-like structure comprising a base and a sidewall enclosing the perimeter of said base, said sidewall having an annular groove therein;

a tubular container having one end with a shape and size appropriate for fitting into said payload support;

a securing means for securing said end of said container in said payload support comprising a ring structure placed in said annular groove, at least two ties, each having one end secured to said tubular container, the other end of each of said ties being secured to said ring structure;

said ties being of such dimensions that they have sufficient aerodynamic drag during free flight of said container assembly to displace said ring structure from said annular groove thereby permitting separation of said payload support from said tubular container.

2. A container assembly for releasing its payload during free flight of the assembly, comprising:

a payload support having a cup-like structure comprising a base and a sidewall enclosing the perimeter of said base, said sidewall having first and second parallel spaced annular grooves;

a tubular container having one end with a shape and size appropriate for fitting into said payload support;

at least two shell members pivotally mounted to the upper end of said container, said shell members having at least two parallel spaced annular ridges at their lower end, said shell members at least partially enclosing said container when pivoted so that said annular ridges are received within said annular grooves;

a securing means for securing said annular ridges in said annular grooves thereby securing said end of said container in said payload structure, a ring structure placed within one of said annular ridges comprising at least two ties, each having one end secured to at least one of said shell members, the other end of each of said ties being secured to said ring structure;

said ties being of such dimensions that they have sufficient aerodynamic drag during free flight of said container assembly to displace said ring structure from within said one of said annular ridges thereby permitting separation of said payload support from said container.

3. A container assembly for releasing its payload during free flight of the assembly, comprising:

a payload support having a cup-like structure comprising a base and a sidewall enclosing the perimeter of said base, said sidewall having an annular groove therein;

a tubular container formed from at least two sections pivoted together at one end whereby the remaining ends are free to pivot away from each other, said remaining ends having at least one inwardly extending ridge for mating with said annular groove;

a securing means for securing said inwardly extending ridge in mating contact with said annular groove comprising a ring structure placed within said inwardly extending ridge, at least two ties, each having one end secured to at leasst one of said sections, the other end of said ties being secured to said ring structure; said ties being of such dimensions that they have sufficient aerodynamic drag during free flight of said container assembly to displace said ring structure from within said annular ridge thereby permitting separation of said payload support from said container.

4. The assembly in accordance with claim 2, wherein said half-shells form a cylinder having a diameter greater than the outside perimeter of said sidewall.

5. The assembly in accordance with claim 1, 2, or 3 wherein the width and thickness of said ties are 50 mm and 0.15 mm, respectively.

* * * * *